US006286354B1

(12) United States Patent
Kajiwara et al.

(10) Patent No.: US 6,286,354 B1
(45) Date of Patent: Sep. 11, 2001

(54) ROLLING MILL AND ROLLING METHOD AND ROLLING EQUIPMENT

(75) Inventors: Toshiyuki Kajiwara, Tokyo; Yoshihiko Iida, Hitachi; Yasutsugu Yoshimura, Hitachi; Kouichi Seki, Hitachi; Ryohei Konose, Hitachi; Mitsuo Nihei, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/155,766

(22) PCT Filed: Apr. 3, 1996

(86) PCT No.: PCT/JP96/00918

§ 371 Date: Aug. 23, 1999

§ 102(e) Date: Aug. 23, 1999

(87) PCT Pub. No.: WO97/36700

PCT Pub. Date: Oct. 9, 1997

(30) Foreign Application Priority Data

Jul. 21, 1998 (JP) ..... 10-204748

(51) Int. Cl.[7] ..... B21B 31/00; B21B 31/07

(52) U.S. Cl. ..... 72/237

(58) Field of Search ..... 72/237, 234, 226, 72/224, 235, 252.5, 365.2, 366.2

(56) References Cited

U.S. PATENT DOCUMENTS 5,121,873 * 6/1992 Sekiya et al. ..... 29/527.7
5,219,114 * 6/1993 Kajiwara et al. ..... 72/234
5,365,764 * 11/1994 Kajiwara et al. ..... 72/234
5,634,257 * 6/1997 Kajiwara et al. ..... 29/527.7
5,636,543 * 6/1997 Kajiwara et al. ..... 72/234
5,931,040 * 8/1999 Kimura et al. ..... 72/234
5,934,130 * 8/1999 Kajiwara et al. ..... 72/249

FOREIGN PATENT DOCUMENTS 5-177214 * 7/1993 (JP) .
7-308701 * 11/1995 (JP) .

* cited by examiner

*Primary Examiner*—Rodney A. Butler
(74) *Attorney, Agent, or Firm*—Evenson, McKeown, Edwards & Lenahan, P.L.L.C.

(57) ABSTRACT

The work rolls of two sets of roller groups are held within one-piece metal chock in a rolling mill. A one-piece metal chock in which the driving side and operating side are separate then provides support at the upper part of the rolling material, with support similarly being provided at the lower part using another pair of single piece metal chocks. Two sets of roll groups can then be arranged close to each other, strip walking and strip curving can be prevented, and a rolling mill, rolling method and rolling installation that are easy to maintain and provide superior rolling efficiency can be provided.

44 Claims, 9 Drawing Sheets

ROLLING MILL AND ROLLING METHOD AND ROLLING EQUIPMENT

TECHNICAL FIELD

The present invention relates to a rolling mill, rolling method and rolling installation for rolling a metal material.

BACKGROUND OF INVENTION

There are two main ways of rolling metal slabs, by rolling a slab through a hot rolling process only or by rolling a slab through a hot rolling process and then a cold rolling process.

In each of the hot and cold rolling methods, rolling techniques can be divided into two methods; reverse rolling methods and tandem rolling methods. In the case of hot rolling of carbon steel there is a reversible rough rolling mill and a five to seven stand tandem-type finishing mill. With hot rolling installations dedicated to rolling stainless steel, a rough rolling mill and a reversing finishing mill having furnace coilers on each side, referred to as "Steckel Mills", are the most common.

Rather than being divided into roughing mills and finishing mills, cold rolling mills are divided into two types: tandem mills for large-scale production; and reverse rolling mills for small-scale production.

With reverse rolling, five to nine passes is usual in hot rolling while three to five passes are common in cold rolling. In tandem rolling, five to seven stands is typical in hot rolling while four to six stands is typical in cold rolling in order to obtain a product thickness in one pass.

Because of this, the disparity in the production volumes of the reversing method and the tandem method is quite large.

Further, in Japanese Utility Model Publication No. Sho. 59-30308 disclosing that relating to rolling of steel bars and wire into cylindrical shapes, a thrust mechanism for regulating shifts of the center of cylinders is disclosed that improves precision of cylinder centering using spherical-shaped supports.

In Japanese Laid-open Patent Publication No. Hei. 5-317918, a tilting member is provided at a sliding surface of a roll chock and a housing in order to dramatically reduce the frictional resistance during raising and lowering of roll chocks for both the work rolls and the back-up rolls to improve the rolled material thickness and strip shape.

Currently, there is a large disparity between the production volume of the reversing method and the tandem method with no practical alternative in response to demands for production volumes lying therebetween.

Reverse rolling is carried out using single rolling mills and one would assume if two rolling mills are used then approximately twice the production volume should be possible. The reasons that this has not been achieved are as follows:

In the case of a hot rolling mill the inter-stand distance is approximately 6 meters. The leading end of the rolling material is then sent from one stand to the next stand, the strip walks and bends so the pass center is displaced from the center and difficulty occurs in biting at the next stand. When biting is carried out offset from the center, strip curving and strip walking occurs, and strip threading does not go well, resulting in a poor strip profile and thickness.

In tandem mills each stand carries out rolling in one direction so strip thickness does not change in one stand of the mill and controlling strip walking is therefore not too difficult. On the other hand, the pass direction changes in reverse rolling methods so that the thickness of the strip being rolled becomes thinner with each pass, i.e. the rolling conditions change. The reduction levelling operation therefore has to be carried out to a high degree of skill and precision, and if the most appropriate level control is not carried out, the strip will walk.

As the amount of strip walking of the leading end is approximately proportional to the square of the length of the inter-stand distance, the amount of strip walking with an inter-stand distance of 6 m is quite large. As a result, strip biting at the following stand is not carried out smoothly and when a walking strip is bitten, strip walking is substantially exacerbated because the strip is not inputted to the center of the rolling mill.

Coilers are provided at the front and rear of a reverse cold rolling mill for coiling and uncoiling during rolling. During this time it is usual for the trailing end of the strip to remain wound onto the coiler. The yield can be improved if the ends of the strip are rolled but strip end passing and recoiling of the strip then becomes very time-consuming, so the productivity falls.

To overcome these difficulties, an invention is put forward with the object of making the distance between two stands as short as possible.

The distance between the centers of the stands can be brought down from 6 m to 3.5 m. Even with this distance side guides are still required for guiding the plate. However, this configuration calls for an airtight space in between the two stands so operation and maintenance becomes troublesome.

Particularly, when strip breakage and crimping occurs, the roll housing becomes a hindrance and the extraction of scrap becomes extremely difficult.

DISCLOSURE OF INVENTION

The object of the invention is to provide an easily maintainable rolling mill, rolling method and rolling installation of a high degree of rolling efficiency with a minimized distance between two sets of roll groups and in which rolled strip walking and bending are suppressed.

The rolling mill of the invention comprises a four-high rolling mill equipped with roll groups composed of upper and lower work rolls above and below a rolling material and upper and lower back-up rolls supporting said upper and lower work rolls, respectively, with two of said roll groups housed within a single roll housing. Mill rolls are driven at one side in an axial direction of said roll groups with operation taking place on a remaining side. The metal chocks of said work rolls support two work rolls as a single body on upper and lower separate driving and operating sides.

The rolling mill of the invention comprises a six-high rolling mill equipped with roll groups composed of upper and lower work rolls above and below a rolling material, upper and lower intermediate rolls supporting said upper and lower work rolls, respectively, and upper and lower back-up rolls supporting said upper and lower intermediate rolls, respectively, with two of said roll groups housed within a single roll housing. Mill rolls are driven at one side in an axial direction of said roll groups with operation taking place on a remaining side. The metal chocks of said work rolls support two work rolls as a single body on upper and lower separate driving and operating sides.

In a rolling method of the invention for a four-high rolling mill equipped with roll groups composed of upper and lower work rolls above and below a rolling material and upper and lower back-up rolls supporting said upper and lower work rolls, respectively, have two of said roll groups housed within a single roll housing. Mill rolls are driven at one side in an axial direction of said roll groups with operation taking place on a remaining side. The metal chocks of said work rolls support two work rolls as a single body on upper and lower separate driving and operating sides, so that said back-up rolls are driven and rolling is carried out.

In a rolling method of the invention for a six-high rolling mill equipped with roll groups composed of upper and lower work rolls above and below a rolling material, upper and lower intermediate rolls supporting said upper and lower work rolls, respectively, and upper and lower back-up rolls supporting said upper and lower intermediate rolls, respectively, have two of said roll groups housed within a single roll housing. Mill rolls are driven at one side in an axial direction of said roll groups with operation taking place on a remaining side. The metal chocks of said work rolls support two work rolls as a single body on upper and lower separate driving and operating sides, so that said intermediate rolls or said back-up rolls are driven and rolling is carried out.

A hot rolling installation of the invention is equipped with a roughing mill and a finishing mill, with said hot-rolling installation rolling hot material at said finishing mill or rolling a slab cast at a thin slab casting as is at a finishing mill. The finishing mill incorporates two sets of roller groups for a four-high rolling mill consisting of upper and lower work rolls and back-up rolls or a six-high rolling mill consisting of upper and lower work rolls, intermediate rolls and back-up rolls within a single housing. A work roll bearing (metal chock) supports two work rolls as a single piece at driving and operating sides individually above and below.

Further, a hot rolling installation of the invention is equipped with a roughing mill and a finishing mill, with said hot-rolling installation rolling hot material at said finishing mill or rolling a slab cast at a thin slab casting as is at a finishing mill. The finishing mill incorporates two sets of roller groups for a four-high rolling mill consisting of upper and lower work rolls and back-up rolls or a six-high rolling mill consisting of upper and lower work rolls, intermediate rolls and back-up rolls within a single housing. A work roll bearing (metal chock) supports two work rolls as a single piece at driving and operating sides individually above and below, with two of said finishing mills being arranged in tandem.

BEST MODE FOR CARRYING OUT THE INVENTION

Figure 1:
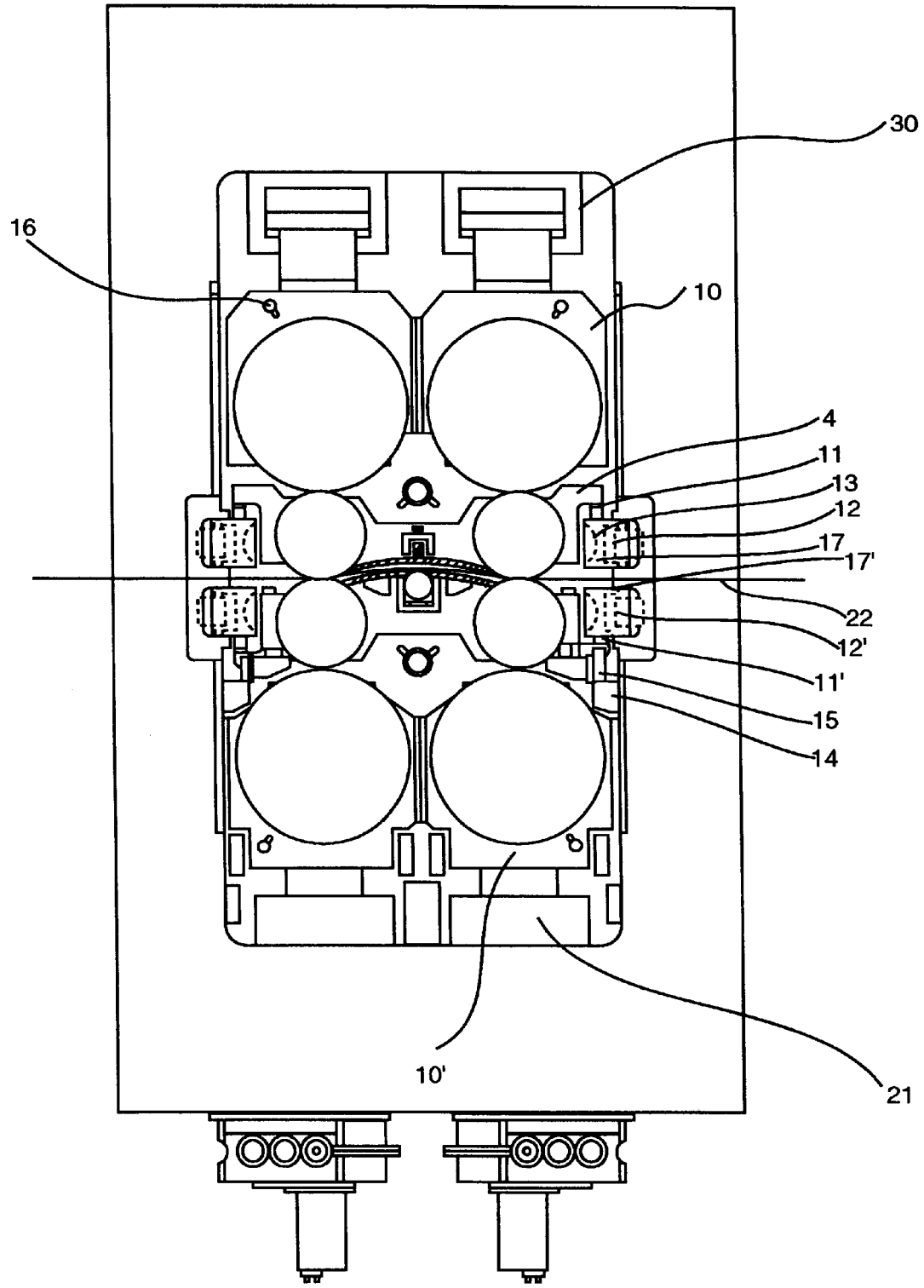
FIG. 1 is a front cross-sectional view of a four-high twin mill constituting a first embodiment of the present invention.

The following is a description of the best mode for carrying out the present invention based on preferred embodiments.

The present invention is for supplying two sets of roll groups within a single housing in such a manner that a spacing of the centers of the two sets of roll groups is dramatically reduced with respect to that of the preceding example to 1.5 meters or less.

This type of rolling mill is abbreviated to a "twin mill". With a twin mill, a distance between stands is one quarter of the 6 meters of the usual tandem example and approximately 40 percent of the 3.5 meters of the close tandem mill. As the amount of strip walking of a strip is approximately proportional to the square of the distance between stands, a 94% reduction in strip walking from the tandem mill configuration is shown in Table 1.

TABLE 1

| method | inter-stand distance | maximum amount of strip walking | side guide |
|---|---|---|---|
| usual tandem mills | 6 m | ±40 mm (assumed) | necessary |
| close tandem mills | 3.5 m | ±13.6 mm | necessary |
| method of the present invention (twin mill) | 1.5 m | ±12.5 mm | unnecessary |

As shown in table 1, a usual tandem mill has a distance between stands of 6 m and an assumed maximum extent of strip walking of ±40 mm and therefore requires side guides.

A close tandem mill has a distance between stands of 3.5 m and a maximum extent of strip walking of 13.6 mm and therefore also requires side guides.

With the twin mill of the method of the present invention, the distance between stands that is the distance between the two sets of rolls is 1.5 m and the maximum extent of strip walking is ±2.5 mm, so that side guides are not required.

The invention is extremely effective in reducing the distance between stands where placement of a strip guide and strip tension meter is problematic.

This problem is resolved by metal chocks for operating rolls being shared by two groups of rolls, i.e. by using one piece-type metal chocks.

As a result, strip threading guides can be formed as one piece, the strip protrudes so as to ensure that there are no discontinuities so that it does not tumble or turn around. Even if problems do occur, the housing does not interfere.

In this method a strip crown and strip shape control function can be added.

During the above strip threading operation, the leading end of the threaded strip has been described but in reality problems occur far more frequently at the trailing end of the threaded strip referred to as slipping of the trailing end.

The reason for this is the differences in the reduction rate at both sides of the strip width caused by discrepancies in the reduction levels on the left and right cause the strip to curve. One side is thicker (over reduced) and the other is thinner (under reduced) than the desired thickness. This cause for curving in hot rolling that is approximately three times greater for the trailing end than for the leading end. As the trailing end is shifted in a bent state, the center of the strip is dramatically displaced from the center of the rolling mill and the difference in the width-wise rate of reduction of the strip continues to deteriorate so that the curving of the trailing end is increased still further.

With this phenomena the trailing end of the strip material is rolled by the previous roll group so as to restrict the swinging of the trailing end, i.e. trailing end curving does not occur.

Trailing end curving starts from the strip material slipping at the previous roll group and when the distance between two roll groups is short the place for this phenomena to occur no longer exists. Further, when the distance between two roll groups is long, strip curving occurs proportionally to approximately the cube of the tail extraction distance.

With reversing mills, the ease with which a strip can be threaded through a twin mill is far superior to that of a rolling mill having a single roll group. Therefore, with any twin mill, even distribution of tension occurs across the width of the strip so that even if there are differences in the reduction rate at both sides of the strip width the influences caused by strip bending etc. are practically eliminated.

First Embodiment

Figure 2:
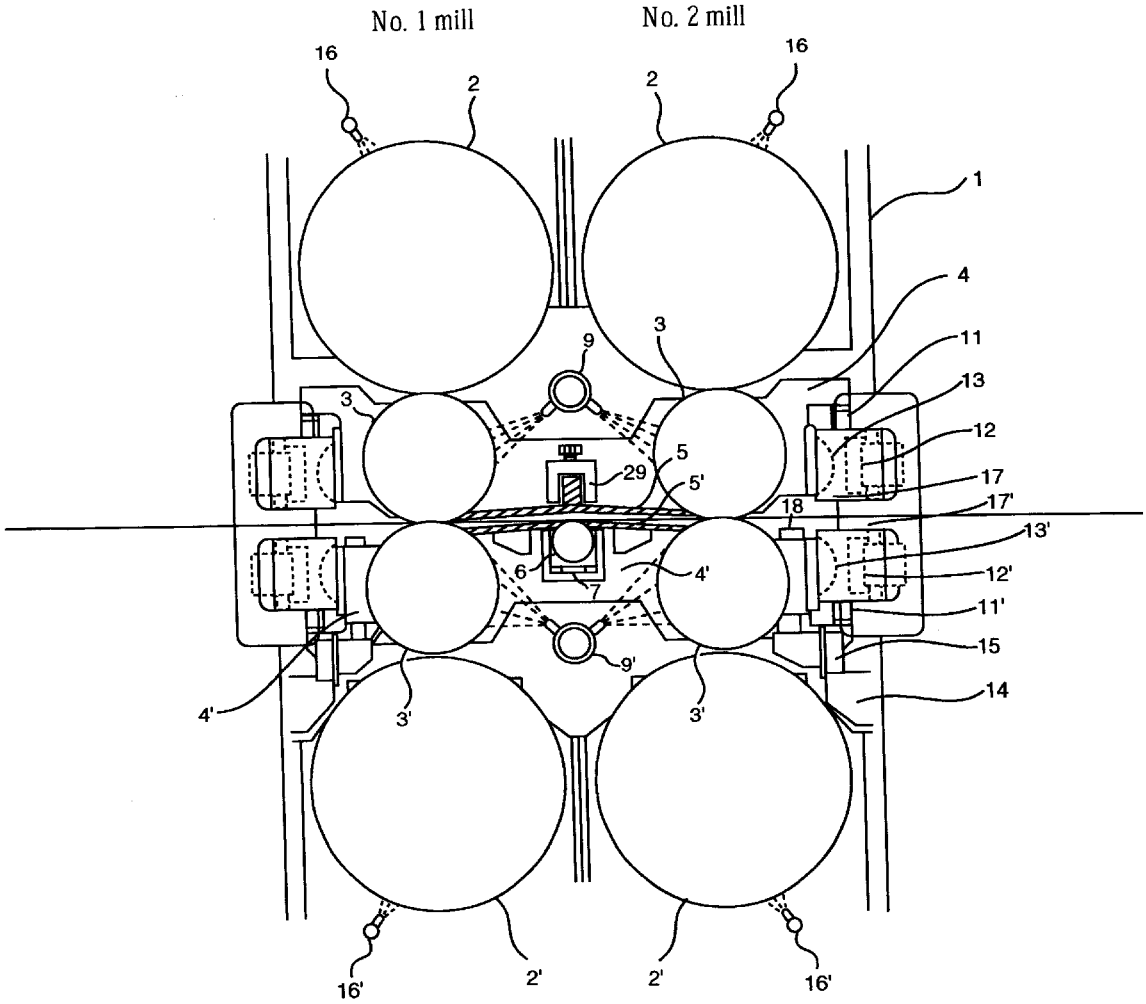
FIG. 2 is a front cross-sectional enlarged view of the four-high twin mill constituting the first embodiment of the present invention.

FIG. 1 shows an example where the present invention is realized as a four-high rolling mill and FIG. 2 is an enlarged view of same.

Two sets of four-high roll groups (No. 1 mill and No. 2 mill from the side of insertion of rolling material) are installed in a single housing 1.

Upper back-up roll 2, upper work roll 3, lower back-up roll 2' and lower work roll 3' make up one roll group set, with two sets within the housing 1, so as to give a total of four back-up rolls and four work rolls.

A set of one roll group then consists of an upper and lower work roll and an upper and lower back-up roll.

Single piece metal chocks 4 and 4' are installed on each of the two upper work rolls 3 and the two lower work rolls 3'.

Strip threading guides 5 and 5' attached to the single piece metal chocks 4 and 4', respectively, can be moved up and down with respect to changes in the diameter of the work rolls using a screw 29 attached to the single piece metal chocks 4 and 4' in such a manner as to adjust the distance between the work rolls.

The strip threading guides 5 and 5' allow easy threading of the slab between the two sets of rolls.

Numeral 6 indicates a tension meter roll provided approximately midway between the two sets of rolls and numeral 7 indicates weighing scales for measuring tension.

Control of tension can then be easily carried out by measuring the tension occurring at the center of the sets of rolls using the tension meter roll 6 and the weighing scales 7.

Pipes 9 and 9' supply cooling water or roll coolant fluid that both cools and lubricates.

Bearings 10 and 10' built-in at the metal chocks for use with the upper and lower back-up rolls receive the rolling load and transmit this force to the housing 1 via reducing equipment 30 that applies this rolling load to the back-up rolls.

Rolling material 22 flows in a direction from the upper left to the right of the drawings and is rolled by the twin mill.

Numeral 11 and numeral 11' indicate pistons for use as roll balance dual operation roll benders.

The pistons 11 and 11' move the single piece metal chocks 4 and 4' up and down.

Numeral 12 and numeral 12' indicate fixed pistons, for moving cylinders 17 and 17' in the pass direction using hydraulic pressure, so as to press the single piece metal chocks from both sides via cylindrical or spherical supports 13 and 13'.

Numeral 15 indicates a wheel for use in rearranging of work rolls. When the lower back-up rolls 2' are lowered, the lower work rolls 3' are also lowered. The lower work rolls 3' are then brought in and out axially in the direction of the rolls via rail 14 and it's metal chocks 4' supported by stepped parts of the wheels 15.

At the same time, the metal chock 4 of the upper work roll is supported by a sliding stopper 18 formed as one piece with the wheel 15, so as to exchange both bottom and top work rolls simultaneously.

Reducing equipment 30 is provided independently for the No. 1 mill and the No. 2 mill so both mills can independently carry out reducing operations.

The screw 21 adjusts a pass line height (pass line) that is the height at which the rolling material flows.

When separate reducing operations are carried out, the metal chocks on the work rolls become inclined with respect to the horizontal.

It is therefore appropriate to provide as the guide surface for the metal chocks a cylindrical support 13 with a surface that is always capable of providing support even when the metal chocks are at an incline.

Variation in roll diameter and inclination of the metal chocks due to individual reducing operations of the individual sets of rolls can still be followed.

In this embodiment, the work rolls are also capable of cross rolling.

When the coolant liquid supplied from the supply pipe 9 is cooling water, lubricant is supplied from a pipe 16 to the surface of the back-up roll in order to alleviate thrusting force when the work roll is crossed with respect to the back-up roll.

The cylinders 17 and 17'0 are made to move in a direction opposite to the direction of the strip pass using hydraulics. The upper and lower work rolls are crossed in opposite directions via the one piece chocks 4 and 4' and the strip crown/strip shape can be controlled.

When this crossing method is used, the cylindrical supports 13 and 13' are taken to be spherical supports responding to corresponding inclination in the vertical and horizontal directions.

By making the sliding surface of the metal chocks and the housing spherical, the inclination of the metal chocks in the vertical and horizontal directions can be followed, which will lead to chock and rolling stability.

Although not shown in the drawings, two metal chocks etc. for that other than rolls are provided on a working side and a driving side, and in the case of cross rolling the cylinders 17 and 17' are made to move in opposite directions on the driving side and the working side.

In FIG. 1 and FIG. 2 the providing of strip threading guides and cooling water pipes at the left side of the No. 1 mill (strip entry side) and the right side of the No. 2 mill (strip exit side) is preferred.

Further, rather than a cross method for the work rolls alone, a cross method where each of the roll axes for the back up rolls and the work rolls are kept parallel is also possible by halting supplying from the pipes 16 and 16' of a lubricant supplying device and also providing horizontal direction shifting equipment at the back-up roll chocks.

As the work roll chocks are formed as one piece roll chocks, the thrust in the axial direction does not change from that for usual methods if keeper plates are provided at the entry side and exit side of the single piece metal chocks, but with the back up rolls, in normal operation, keeper plates can only be provided at one side of the back-up roll chocks and there is the danger that offset loads will be exerted upon the thrust bearing.

If the back up roll chocks are pressed from the housing side, the drifting of the back up roll axis can be prevented. However, when the thrust is large, a large pressing force is required with the regrettable consequence that the resistive force of the reducing operation has a detrimental influence on control of the strip thickness.

Figure 15:
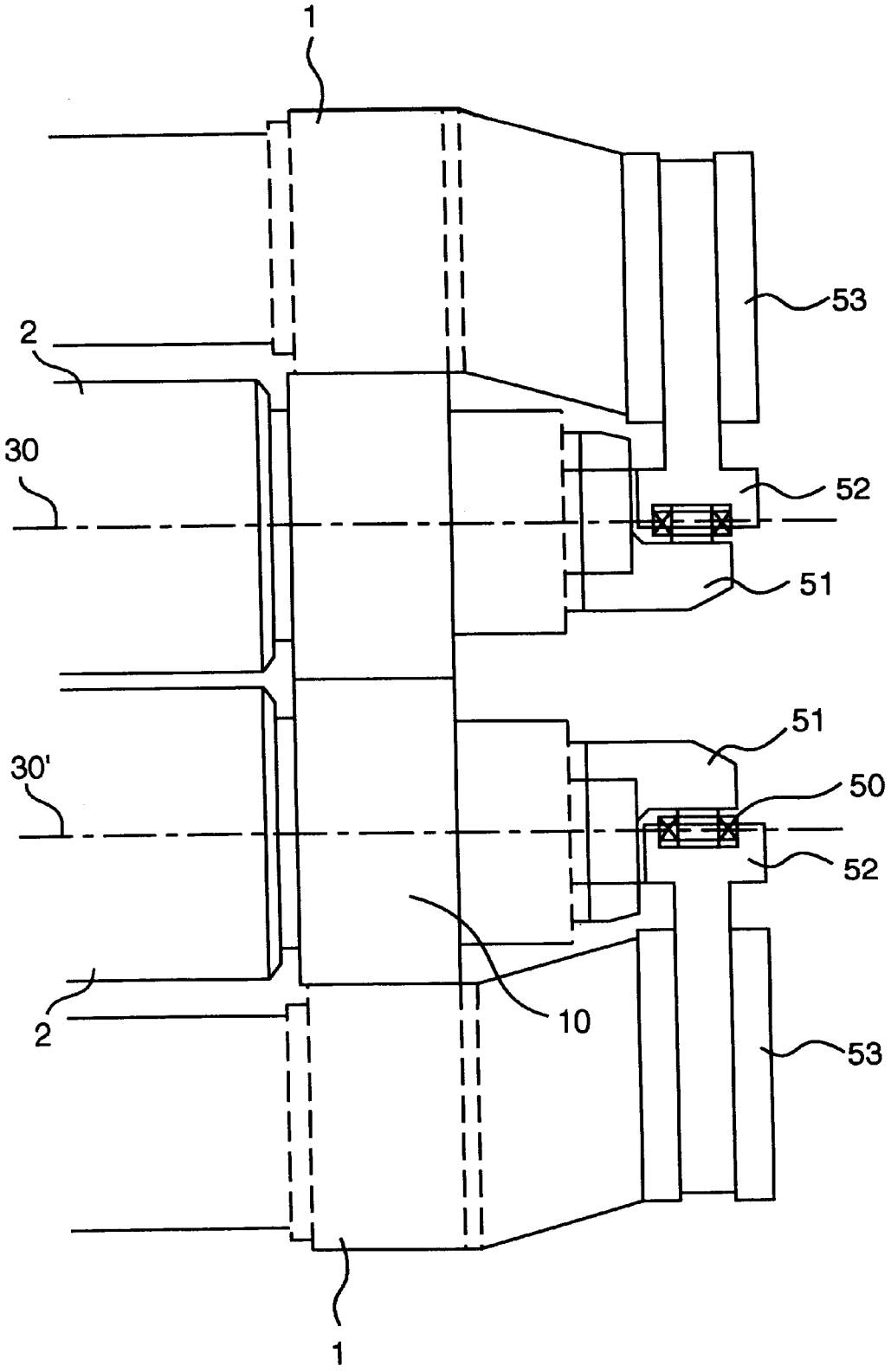
FIG. 15 is a plane view showing a mechanism for thrust bearing in the axial direction of the back-up rolls of the twin mill of the present invention.

In this case, as shown in FIG. 15, this can be resolved by providing keeper plates 52 at the center of each of the back-up roll metal chocks 10.

The keeper plates 52 are supported by a bracket 53 fixed to the housing 1, engage with a roll bearing 50 attached to the front end of a thrust arm 51 fixed to the metal chock 10 for use with the back-up rolls, and transmits thrust generated at the back-up rolls 2 to the housing 1.

As shown above, the following results are achieved with this embodiment.

(1) In a basic structure for a twin mill of a four-high rolling mill, the distance between two sets of a roll groups can be made short by supporting two work rolls using a one piece work roll metal chock formed individually for upper and lower parts and where the driving sides and working sides are separate. In this embodiment, this distance can be made to be 1.5 m or less.

(2) By attaching strip threading guides, threading of the leading end of a strip can be made easy.

(3) Tension between stands can be measured and control of tension can be made easy by installing a tension meter.

(4) By providing cylindrical supports, inclination of chocks due to changes in roll diameter can be followed, surface contact can always be maintained and chock stability, i.e. rolling stability can be maintained.

(5) By crossing only the work rolls, increases in performance of controlling the strip crown and strip shape can be achieved.

(6) By crossing the work rolls and the back-up rolls as one piece, the generation of thrusting force between the work rolls and the back-up rolls can be reduced and performance in controlling the strip crown and strip shape can be increased.

(7) By providing spherical supports, whether just the work rolls are crossed or the work rolls and the back-up rolls are crossed, inclination of the chocks due to changes in roll diameter can be followed, surface contact can always be maintained and chock stability and rolling stability can be maintained.

(8) By moving the work rolls in opposite directions in the axial direction performance in controlling the strip crown and strip shape can be improved, and edge drop reduction and wear dispersion can be achieved.

(9) By bearing thrust in the axial direction with a single thrust bearing device at the roll axis, the application of offset loads to the thrust bearings for the back-up rolls can be prevented.

(10) By pressing across the work roll chock and the sliding surface using hydraulics any intervening gap is removed and rolling stability can be achieved.

(11) By carrying out chock grinding, a roll grinding operation is simplified and the time taken for grinding is shortened.

Second Embodiment

Figure 3:
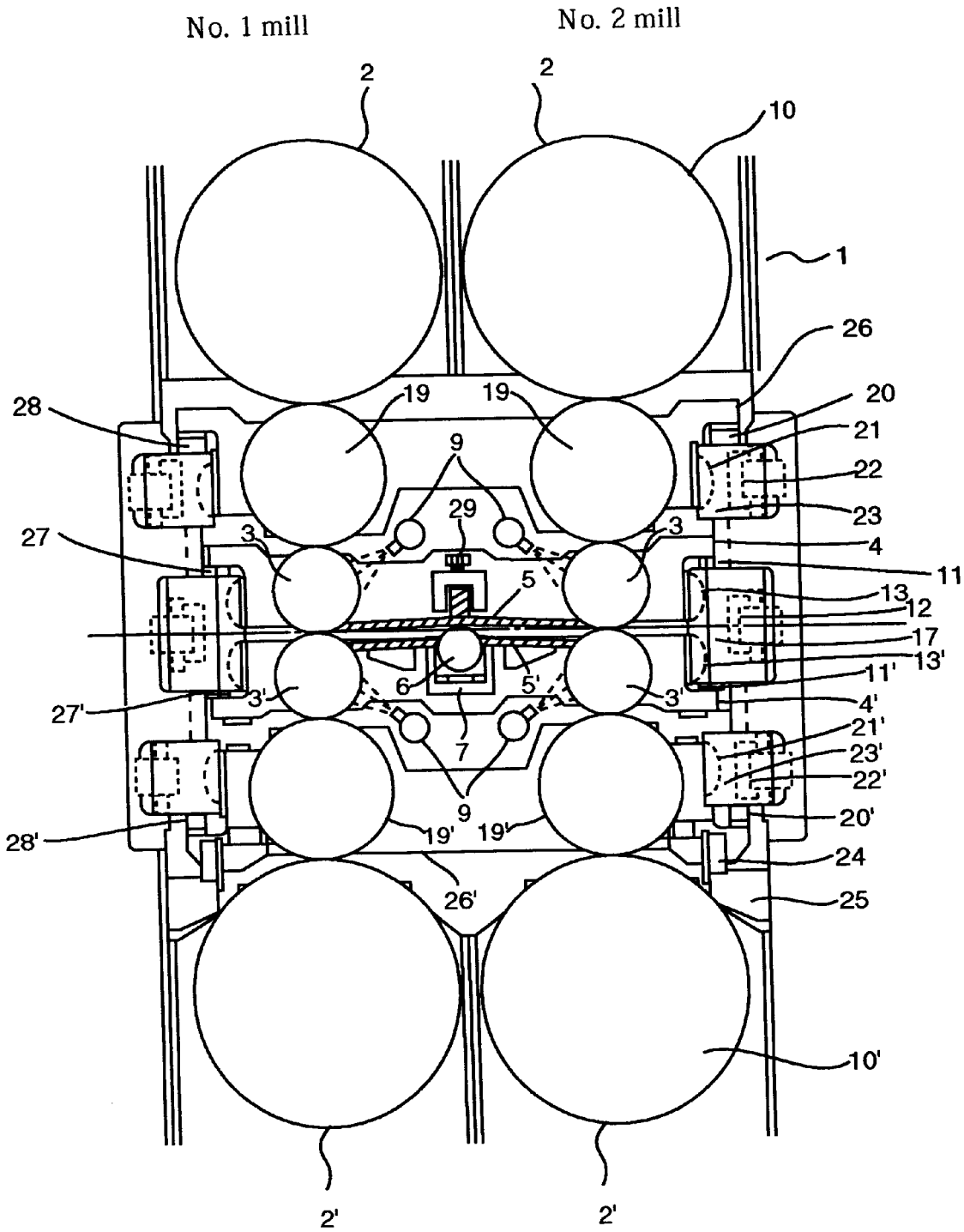
FIG. 3 is a front cross-sectional enlarged view of a six-high twin mill constituting a second embodiment of the present invention.

FIG. 3 shows a twin mill of a six-high mill configuration.

The point of distinction with the four-high mill configuration of FIG. 1 and FIG. 2 is that two upper and two lower intermediate rolls 19 and 19' are provided. In this example intermediate roll chocks 26 and 26' are also used in common as a one piece.

Six-high rolling mills that shift in an intermediate roll axial direction are well known but a method, analogous with the related method, where a mechanism that shifts rolls with an intermediate roll chock one piece structure is installed is also possible.

In this case, the shift position of the intermediate rolls of the two rolling mills is the same but operation is not inconvenienced as this position is mainly decided by the rolling material strip width.

Slight differences are controlled by work roll benders 11, 11', 27 and 27' and intermediate roll benders 20, 20', 28 and 28'.

The driving rolls are usually the work rolls but when it is preferable for the diameter of the work rolls to be small the intermediate rolls are made to perform the driving.

As described above, this embodiment brings about the following results.

(1) In a basic structure for a twin mill for a six-high rolling mill, the distance between two sets of roll groups can be made short by supporting two work rolls using one piece work roll metal chocks formed individually for upper and lower parts and where the driving sides and working sides are separate.

(2) A keeper strip structure can be made simple by forming intermediate roll metal chocks for a twin mill method six-high mill as a one piece.

(3) With intermediate roll or back-up roll driving method rolling mills, a large increase in biting can be achieved by a the operation of work roll benders.

(4) Further dramatic increases in biting can be achieved in twin mills employing methods where intermediate rolls or back-up rolls are driven by setting work roll benders to values that are greater than preset values.

(5) Increases in performance when controlling strip crown and strip shape can be achieved by moving two upper and two lower intermediate rolls in opposite directions in axial directions using common metal chocks.

(6) Increases in performance when controlling strip crown and strip shape together with edge drop reduction and wear dispersion can be achieved by moving two upper and two lower intermediate rolls in opposite directions in axial directions using common metal chocks and also moving work rolls in opposite upper and lower directions in axial directions using common metal chocks.

Third Embodiment

The following is a description of the invention applied to a hot reverse rolling mill.

The production capacity of a typical hot strip mill having a tandem method finishing mill is three to six million tons per year.

Figure 6:
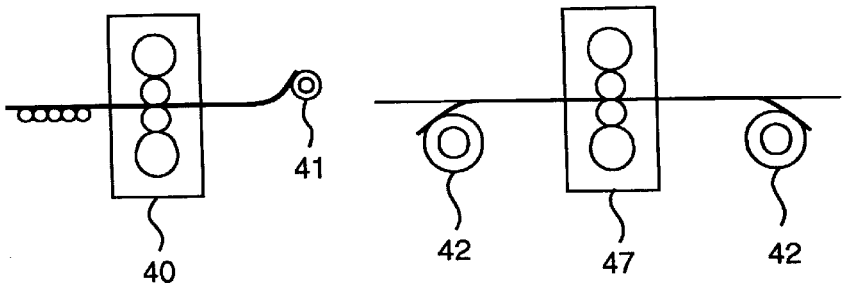
FIG. 6 is a view showing an example of a related hot-rolling installation.

As shown in FIG. 6. an installation having one roughing mill 40 and a finishing mill of one reverse rolling mill 47 has a production of six hundred to eight hundred thousand tons for carbon steel rolling.

At the installation of FIG. 6, a cast slab is rolled to a thickness of approximately 200 mm by the roughing mill 40. The rolled material is then coiled on by a coiler 41. The rolled material is then coiled and uncoiled by a coiler/uncoiler 42 and reverse rolling is then performed by the reverse rolling mill 47.

However, a mill with a production capacity of one to two million tonnes has yet to be realized.

Figure 7:
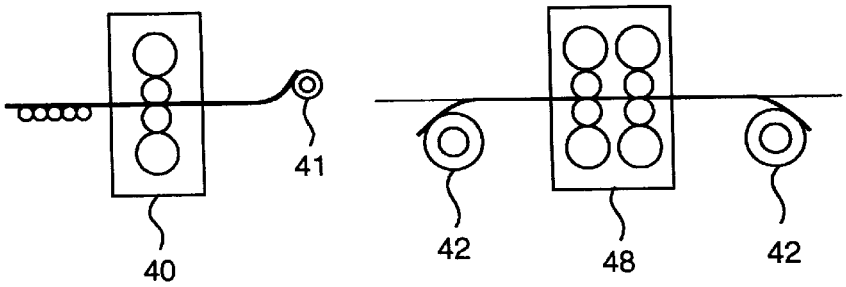
FIG. 7 is a view showing a cold rolling installation employing the twin mill constituting the first embodiment of the present invention in reversing method cold finishing rolling.

FIG. 7 shows the twin mill of the present invention applied to a reversing finishing mill.

At the installation of FIG. 7, a cast slab is rolled to a thickness of approximately 25 mm by the roughing mill 40. The rolled material is then wound on by a coiler 41. The rolled material is then wound and unwound by a coiler/uncoiler 42 and reverse rolling is then performed by a reverse twin mill 48 of the present invention.

Comparing with a single reversing finishing mill, production can be doubled to 1.2 to 1.6 million tons with an increase in installation costs of approximately 30 percent.

In the case of normal steel strip rolling, related reversing mills referred to as "Steckel Mills" were limited to using high pressure water in descaling in order to reduce the temperature of the strip material which caused problems regarding surface quality. This means that these related mills were used primarily for stainless materials. However, in the present invention this problem has been resolved by reducing the number of passes by half and application to carbon steel strips is therefore also possible.

Further, as strip passing is much improved, strip passing/tail extraction speed can be made quicker than in the related art and the drawback of substantial lowering of the temperature at the leading and following ends of a coil in the related method can be substantially improved.

On the other hand, with hot rolling of a stainless material, in addition to preferable conditions where it is difficult for scaling to occur, there is also the important benefit that the end parts of the strip, of a strip thickness that is easy to become cool, are heated by the furnace coiler of the Steckel Mill.

Further, there is still the most substantial problem that the strip is curved when the tail of the threaded strip is extracted so that the tail extraction speed cannot be increased and the temperature of the leading and following ends of the strip fall. The strip therefore becomes hard and the quality of the strip crown etc. is reduced.

The twin mill of the present invention sets out to dramatically improve this problem and provides a method that can be made use of with both normal steel and stainless steels.

As already described above, the guide between mills is an important element, particularly with reversing methods and as the work roll chock one piece method is used, the guide has to be continuous without breaks and without leading end protrusions.

As described above, by applying a twin mill to reversing method rolling, approximately twice the production can be achieved with installation costs of 1.3 to 1.5 times more compared with single mill reverse rolling.

Fourth Embodiment

The following is a description of the present invention applied to a thin slab directly coupled hot strip mill.

Conventionally, slabs supplied to hot strip mills have been approximately 200 mm thick but in recent years have become as thin as 50 to 70 mm thick due to the development of thin slab continuous casts.

Here, a slab is rolled to a thickness of approximately 50 to 70 mm by a thin slab continuous caster 45 and this rolled material is then wound on by the coiler 41. The rolled material is then unwound from an uncoiler 43 and rolled for finishing by a six stand tandem mill.

At this tandem mill, a four-high rolling mill is arranged in an order from the rolling material input side of No. 1 stand 60, No. 2 stand 61, No. 3 stand 62, No. 4 stand 63, No. 5 stand 64 and No. 6 stand 65.

In this way, a method where a rough mill is eliminated and roughing down is omitted by making a slab thickness thin using a thin slab continuous foundry and then rolling using a 5 to 6 stand tandem rolling mill or a method where rolling is carried out in continuation with upstream only continuous casting and a slab is then cut off and passed through a tandem rolling mill can be realized.

In either method threaded strip tail extraction is required at the tandem mill.

Continuity in hot strip mills is a long-cherished hope of the industry and as this would give release from threaded strip tail extraction operations, strongly reducing, thin material rolling would become possible and yields would therefore increase.

Because of this, in the related large type hot strip mill method, a method has been developed where the trailing end of a strip and the leading end of a subsequent strip are joined between a rough mill and a finishing mill so as to achieve continuity.

Development of new technology for this purpose requires substantial investment. If a continuous casting and hot strip mill are linked, continuity can be achieved without making alterations or providing connecting equipment However, the rolling speed at each stand is decided by a continuous casting speed. The continuous casting speed is currently limited to approximately 5 m per minute, which is slow for a rolling speed. In addition to the temperature of the strip falling, scale is generated between the stands in related methods where the distance between stands is 5 to 6 m. If high pressure water is then used for descaling, the temperature also falls and a prescribed finishing temperature cannot be maintained.

In actual conventional results, the time that is allowed to pass for descaling not to be required is less than six seconds.

As a way of carrying out natural descaling between the roughing mill, the temperature is made to rise using an inductance heater etc. at the finishing mill input side so as to provide descaling via entry to the finishing mill.

As shown in table 2, the time from exiting the No. 1 finishing mill to entering the No. 2 finishing mill is in excess of 7 seconds for a distance of 5 m, and the passage of time is further increased when the reducing rate of No. 1 is still lower or the continuous casting speed is slower than 5 m per minute. Descaling is therefore required and maintaining the finishing temperature (850° C. to 900° C.) becomes difficult.

TABLE 2

| | continuous cast | roughing mill No. 1 | descaling | roughing mill No. 2 | finishing mill No. 1 | finishing mill No. 2 | finishing mill No. 3 |
|---|---|---|---|---|---|---|---|
| strip width | 50 | 30 | — | 15 | 6 | 30 | — |
| reduction rate % | | 40 | — | 50 | 60 | 50 | — |
| speed m/min | 5 | 8.3 | — | 16.7 | 41.7 | 83 | — |
| interstand distance m | — | — | 5 | — | 5 (1.5) (at the time of a twin mill) | | 5 |
| seconds elapsed | — | — | 36 | — | 7.2 (2.2) at the time of a twin mill | | 36 |

The twin mill of the present invention can dramatically reduce this to 2.2 seconds.

Figure 9:
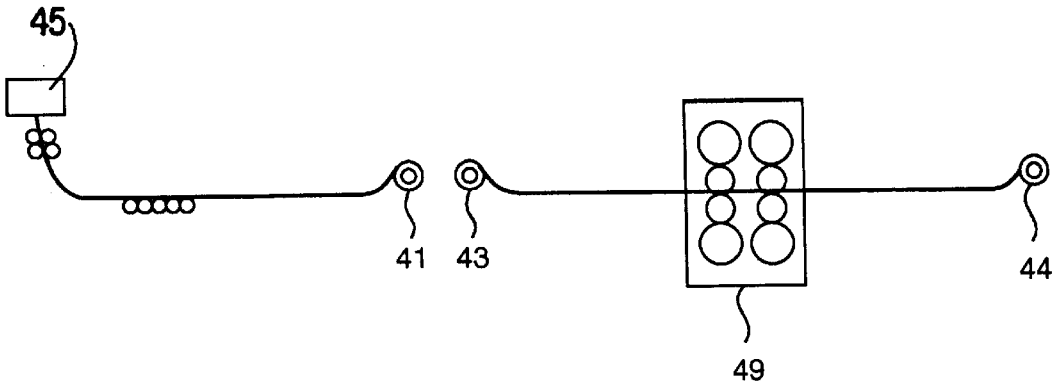
FIG. 9 is a view showing a hot rolling installation employing a thin slab continuous casting and the twin mill of the present invention.

This configuration is shown in FIG. 9.

At the installation of FIG. 9 a slab is rolled thinly to a thickness of 50 to 70 mm by the thin slab continuous caster 45, with this rolled material being wound on by the coiler 41. This rolled material is then unwound by the uncoiler 43 and then rolled for finishing by a four-high twin mill 49 that is the twin mill of the present invention.

In this example, one four-high twin mill of the present invention is arranged as a finishing rolling mill.

It is preferable, however, for the slab from the thin slab continuous caster 45 to be rolled for finishing as is without being coiled.

When products of a thin strip thickness are required finishing mill No. 3 onwards are required but as the rolling speed is high in these cases a distance between mills of 5 m does not present a problem.

Increases in production and rolling stability can be achieved by arranging twin mills in tandem.

Fifth Embodiment

Next, the application of the present invention to a finishing mill of a usual hot strip mill is described.

Generally, the number of stands in a hot finishing tandem mill is 4 to 7, with examples of configurations of 6 to 7 being particularly common.

This number of mills increases with production and with high speed rolling but another important element is product strip thickness.

In order to produce products of a thin strip thickness substantial reducing of the thickness of a bar outputted from a roughing mill is required at a finishing mill.

When reducing per one stand is substantial, strip throughput and strip shape deteriorate and product quality falls.

This tendency becomes more marked as the strip becomes thinner and as the rolling speed becomes faster at stands of subsequent stages.

Table 3 shows an example of a rolling schedule for rolling to a minimum strip thickness of 1.2 mm at a hot strip mill comprising six finishing mills.

Here, a work roll diameter of 700 mm is adopted and a four-high rolling mill is used.

TABLE 3

| Mill NO. | 1 | 2 | 3 | 4 | 5 | 6 |
|---|---|---|---|---|---|---|
| strip thickness (mm) | 25/10 | 5.3 | 2.9 | 1.9 | 1.4 | 1.2 |
| amount of reduction (mm) | 15 | 4.7 | 2.4 | 1.0 | 0.5 | 0.2 |

TABLE 3-continued

| Mill NO. | 1 | 2 | 3 | 4 | 5 | 6 |
|---|---|---|---|---|---|---|
| reduction rate (%) | 60 | 47 | 45 | 34 | 26 | 15 |

As can be understood from the example shown in table 3, the reduction at the extremities is lower at latter stands compared with the former stands.

The main reason for this, as well as deterioration of the strip shape and deterioration of the surface quality of the plate, is that the strip threading/tail extraction failure rate dramatically increases at the depression rate increases.

In reality a six-high rolling mill of superior shape control is used but it cannot be said that the reduction rate of the final stand is raised dramatically because of the reasons stated above.

This is shown by the fact that the strip passing deteriorates as the depression rate of a later stands increases.

If a twin mill is therefore provided as a final stand, the strip passing is markedly improved and a substantial reduction is possible.

In order to achieve this, arrangement of a cross mill with enhanced shape control performance or a six-high rolling mill that exhibits shape control using a small diameter work roll is preferred.

Figure 10:
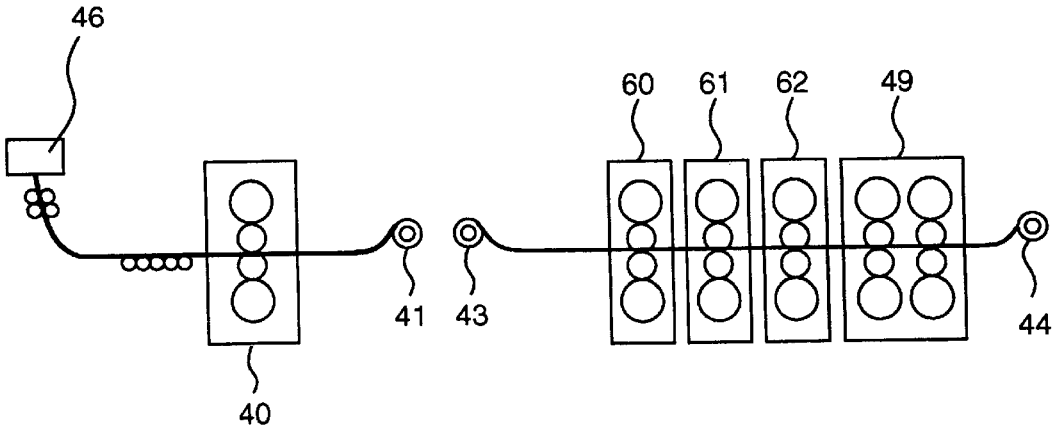
FIG. 10 is a view showing a hot rolling installation constituting an embodiment of the present invention.

In this case, as shown in FIG. 10, rolling to 1.2 mm can easily be achieved with a configuration comprising three usual rolling mills and one twin mill.

With the installation of FIG. 10, a slab cast by a continuous casting 46 is rolled to a thickness of approximately 25 mm by the roughing mill 40. This rolled material is then wound on to the coiler 41 and then wound out to the finishing mill side from the uncoiler 43.

The rolled material unwound from the uncoiler 43 is then rolled for finishing by three conventional rolling mills (No. 1 stand 60, No. 2 stand 61 and No. 3 stand 62) and a four-high twin mill 49 of the present invention.

An example rolling schedule for this layout is shown in table 4.

TABLE 4

| mill | related mill | | | twin mill | |
|---|---|---|---|---|---|
| mill No. | 1 | 2 | 3 | 4 | 5 |
| strip thickness (mm) | 25/10 | 5.3 | 2.9 | 1.7 | 1.2 |
| amount of reduction (mm) | 15 | 4.7 | 2.4 | 1.2 | 0.5 |

TABLE 4-continued

| mill | related mill | | | twin mill | |
|---|---|---|---|---|---|
| mill No. | 1 | 2 | 3 | 4 | 5 |
| reduction rate (%) | 60 | 47 | 45 | 40 | 30 |

Figure 11:
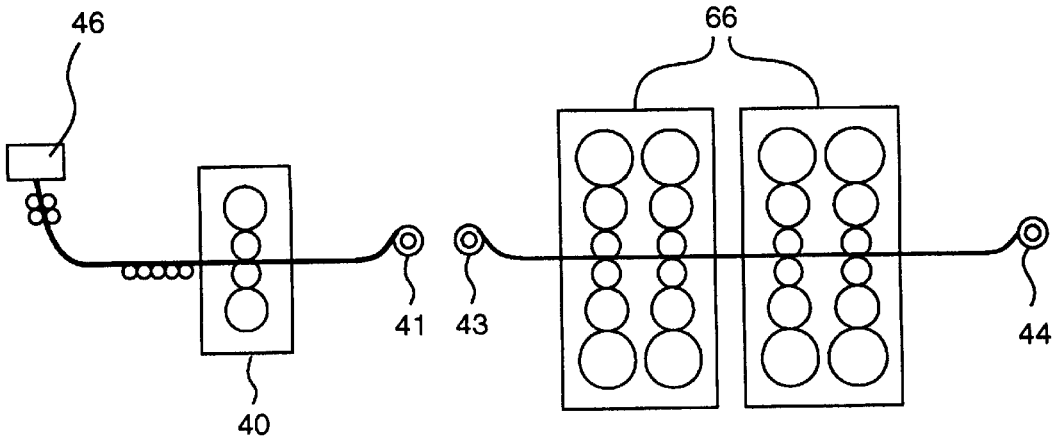
FIG. 11 is a view showing a hot rolling installation constituting an embodiment of the present invention.

As shown in FIG. 11, if a six-high twin mill 66 employing work rolls of a small diameter is taken as the twin mill then the reduction rate can be made larger.

Here, a small diameter is a radius of less than approximately 450 mm.

When twin mills are applied at all stands, it is necessary for all of the mills to be six-high mills having small diameter work rolls in order to output products of a thickness of 1.2 mm from a 25 mm bar using two twin mills.

For particularly the leading stage twin mills, as driving of the work roll is strictly not permitted, intermediate roll driving is required.

The rolling schedule in this case is shown in table 5.

TABLE 5

| mill | No. 1 Twin Mill | | No. 2 Twin Mill | |
|---|---|---|---|---|
| Mill No. | 1 | 2 | 3 | 4 |
| (mm) | 25/8.8 | 3.9 | 2.0 | 1.2 |
| (%) | 16.2 | 4.9 | 1.9 | 0.8 |
| (%) | 65 | 55 | 50 | 40 |

A work roll of a diameter of 700 to 800 mm has been generally used in a conventional hot strip mill for the following reasons.

1) As the rolling mills are mostly four-high rolling mills, small diameter rolls cannot be applied in order to maintain a superior strip crown and strip shape.
2) With the exception of the special case of planetary mills, in hot rolling the work rolls are driven as a general rule with usual two-high, four-high and six-high mills. Because of this, particularly in the front stage, the roll diameter cannot be made small because of the strength of the torque transmission.

The work roll diameter could also not be dramatically changed at the latter stages because of interchangeability and even if an intermediate roll shift-type six-high mill capable of small diameters is used, the work roll driving still has to be housed within the permitted dimensions.

3) There are limitations to small diameters in order to maintain work roll quality.

This problem has, however, been overcome by a roll of a new material referred to as a high-speed steel roll.

Namely, problems regarding the small diameter of the work roll can be resolved with the exception of driving if a work roll that is a high-speed steel roll is used in a six-high mill of superior strip crown and strip shape control performance.

When a small diameter work roll is required in cold rolling, back up roll driving or intermediate roll driving is widely used.

If this method is adopted in hot rolling also these problems should be resolved but, for example, it is thought that slips will occur between rolls due to the frictional force between the rolls being insufficient with intermediate roll driving and up until now not one has actually been made.

As a result of making this point clear, the present invention will confirm that sufficient reduction can be obtained using small diameter work rolls for back-up roll driving (the same as for intermediate roll driving).

In order to achieve an amount of reduction, a work roll radius is taken to be Rw, a coefficient of friction between a work roll and a material is taken to be $\mu$b, and a coefficient of friction between a driver roll and a work roll is taken to be $M_{r.}$, a permitted maximum amount of reduction after completion of biting is taken to be $\Delta h_r$, the amount of reduction that can be achieved during biting is taken to be $\Delta h_b$, P is taken to be the rolling load and K is taken to be the mill constant of the rolling mill, so that:

$$\Delta h_r = 4\mu_b^2 Rw: \text{ during work roll driving} == 4\mu_r^2 Rw: \text{ during intermediate roll driving} \quad (1)$$

$$\Delta h_b = \mu_b^2 Rw - P/K: \text{ during work roll driving} = \mu r^2 Rw - P/K: \text{ during intermediate driving} \quad (2)$$

From equation (1) and (2), $\Delta h_b$ is one quarter or less of $\Delta h_r$ and the actual amount of reduction is decided to be $\Delta$hb if measures such as rolling after strip threading and making a leading end of cover material thinner are not carried out.

Figure 4:
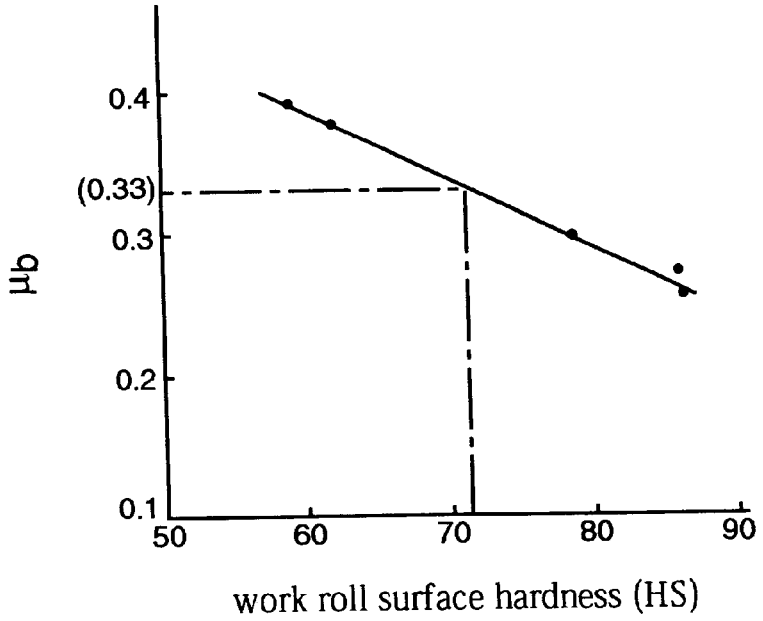
FIG. 4 is a view showing results of measuring coefficient of friction with respect to work roll surface hardness.
Figure 5:
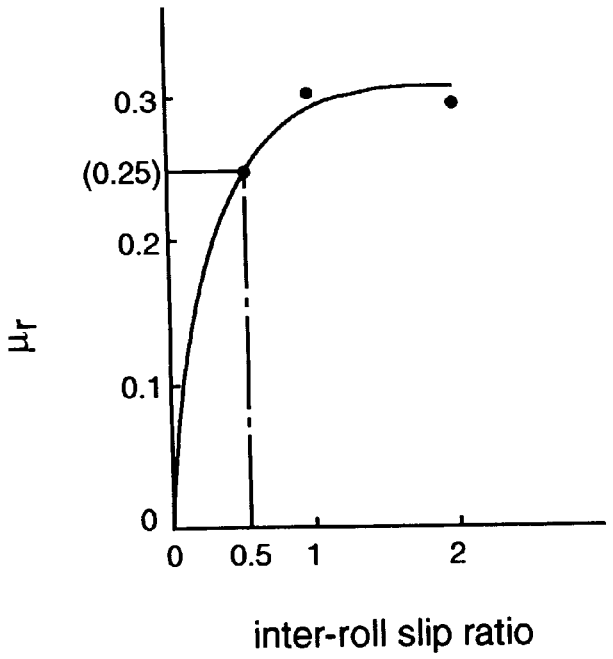
FIG. 5 is a view showing results of measuring coefficient of friction with respect to inter-roll slip ratio.

Experimental results for the coefficients of friction $\mu_b$ and $M_{r.}$ that constitute substantial factors in deciding the necessary work roll diameter are shown in FIG. 4 and FIG. 5.

The coefficient of friction $\mu$b of the work rolls and the leading end of the strip has a strong correlation with the hardness of the surface of the rolls with the work roll surface hardness within the practical range, with $\mu$b falling as the roll hardness rises. Keeping $\mu_b$ equal to or less than HS70 is preferable at the previous stage mill when a large amount of biting is required to keep $\mu_b$ at 0.33.

On the other hand, the coefficient of friction Mr. between a work roll and a driver roll (for example, an intermediate roll) is generated by slipping between the rolls and with a slip ratio of approximately 1%, in the case of water cooling, a maximum value of 0.3 is reached.

If the margin is viewed and the Mr. at the time of a slip ratio of 0.5% is used, then Mr.=0.25%.

If it is assumed that P/K=2400 Tf/400 Tf/mm=6 mm, when a work roll diameter of 420 mm i.e. Rw=210 mm is assumed, in the case of work roll driving, $\Delta h_b$=0.332×210−6=16.8 mm, and an amount of depression of 16.2 mm for the No. 1 mill of table 5 is achieved.

On the other hand, in the case of intermediate roll driving, $M_{r.}$ is used in place of $\mu_b$ and $\Delta h_b$ is dramatically reduced to $\Delta h_b$=0.252×210−6=13−6=7 (mm).

In this case, as the rolling load is also reduced there is also an increase of 1 to 2 mm which is remarkably different from work roll driving of 16.8 mm.

Next, a description is given of a method of easily raising the defects of this intermediate roll driving method to the same performance as the work roll driving method.

When a strip is passed under strip biting conditions where a maximum value of $\mu_b$ is used in the case of work roll driving, then $M_{r.}<\mu_b$ and slipping therefore occurs between the work roll and the intermediate roll.

In order to prevent this, it is necessary to push the material with a force F shown in equation (3).

$$F = BSRw(\mu_b - M_{r.})^2 \quad (3)$$

Here, B indicates strip thickness and S indicates flow stress.

Providing of a pushing device is not impossible but as the material also buckles the providing of a pushing device close to the mill is by no means straightforward.

The method put forward here simply sets the bender force of already existing work rolls to above a certain value without adding new equipment.

The coefficient of friction Mr. cannot be set to be large.

The frictional force is important however, and is the load between the rolls multiplied with Mr.

The load between the rolls is the total of the rolling load and the work roll bender (or roll balance) force.

If F of equation (3) is calculated on the basis of this bender force, the required bender force per each upper and lower work roll becomes:

$$Fw=F/(2\mu_r)=\{BSRw(\mu_b-M_r)^2\}/(2\mu_r) \quad (4).$$

If it is assumed that B=1600 mm, Rw=210 mm and S=20 kg/mm2, and as above, $\mu$hd b=33 and $\mu_r$=0.25, then:

$$Fw=\{1600\times20\times210\times(0.33-0.25)^2\}/2\times0.25=86\times10^3 \text{ kgf}=86 \text{ Tf}$$

This is then the permitted bender force for a work roll diameter of 420 mm.

This result is a rolling result using a back-up roll driving method four-high rolling mini-mill where the biting performance is greatly influenced by changes in the work roll balance force with a $\Delta h_b$=12 mm being obtained for a work roll of a diameter of 170 mm so as to prove the validity of the above theory.

This result then proves that sufficient reduction can be obtained with intermediate roll driving even when using a small work roll.

Figure 8:
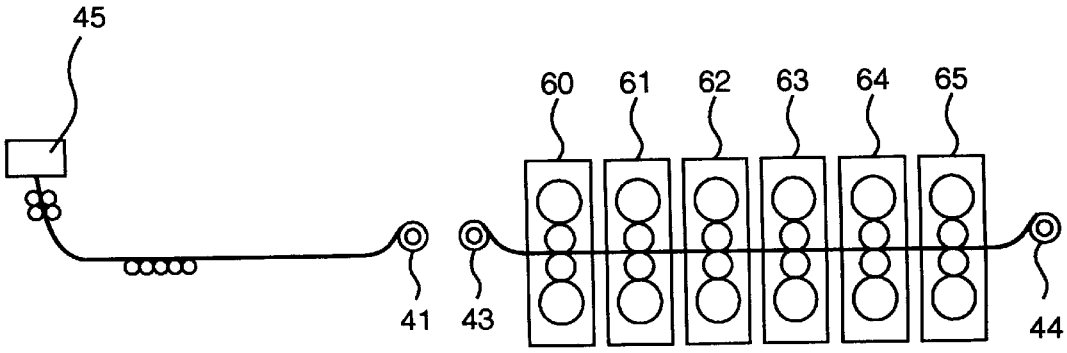
FIG. 8 is a view showing a hot rolling installation employing a thin slab continuous casting and a related six stand tandem mill.

For comparison with a related method for a hot finishing tandem mill such as the series of finishing mills of FIG. 8, an example of a twin mill arranged as a rear stage is shown in FIG. 10 and an example where two twin mills constitute the entire configuration is shown in FIG. 11.

Figure 12:
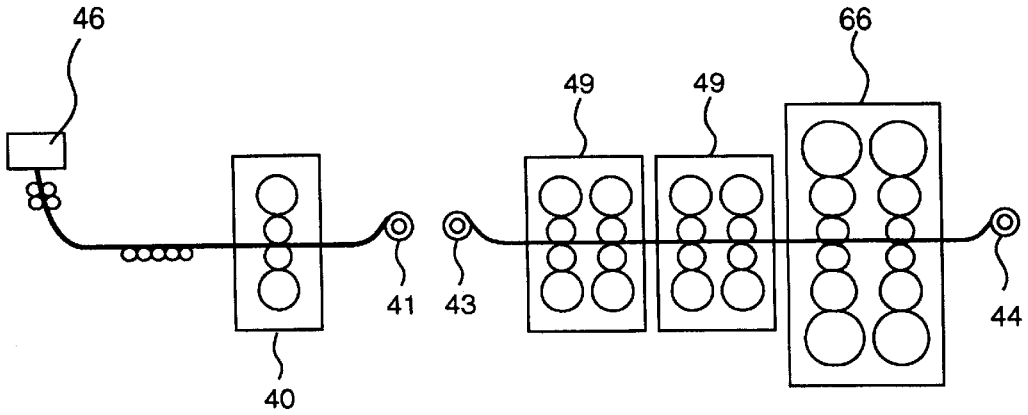
FIG. 12 is a view showing a hot rolling installation constituting an embodiment of the present invention.

As shown in FIG. 12, three of the twin mills of the present invention are provided, for which two four-high twin mills 49 and one six-high twin mill 66 is preferred.

Figure 13:
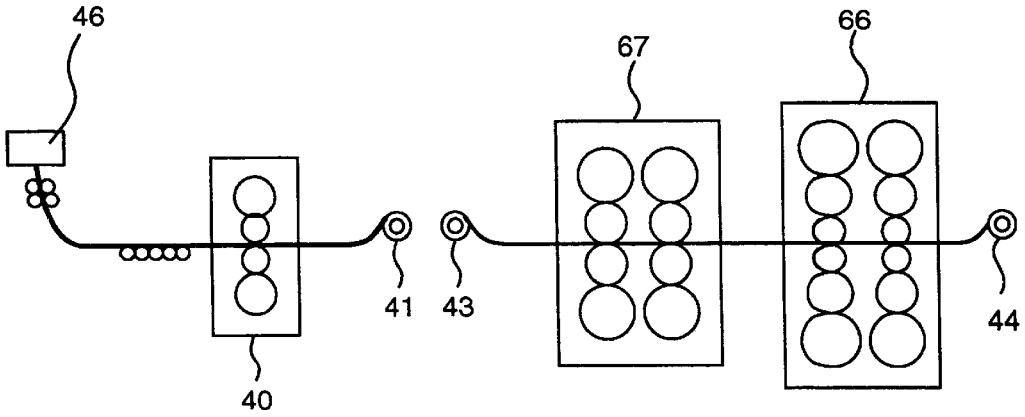
FIG. 13 is a view showing a hot rolling installation constituting an embodiment of the present invention.
Figure 14:
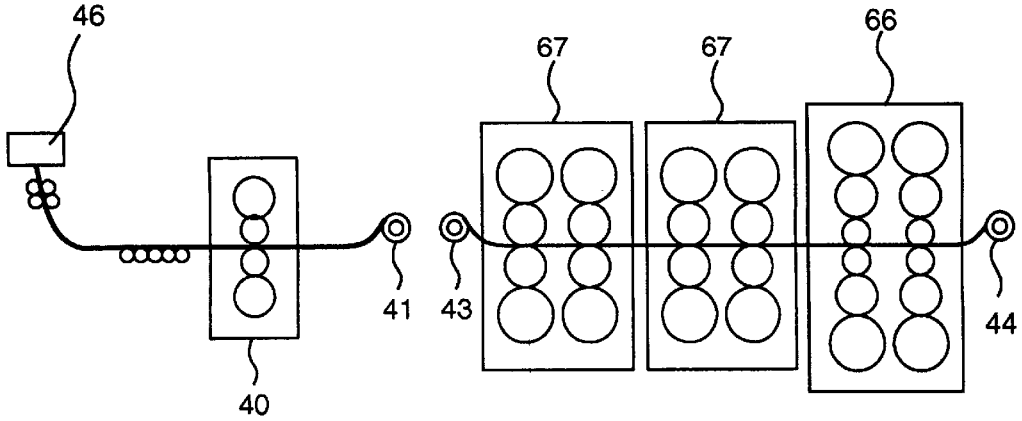
FIG. 14 is a view showing a hot rolling installation constituting an embodiment of the present invention.

It is preferable for at least one four-high twin mill 67 to be provided at the front part constituting the input side of the series of finishing mills for the rolled material as shown in FIG. 13 and FIG. 14 and for a six-high twin mill 66 to be provided at the rear part constituting the output side of the series of finishing mills.

With the hot rolling installations of FIG. 13 and FIG. 14 it is preferable for the work roll diameter of the four-high twin mill provided at the front part to be large and the work roll diameter of the six-high twin mill provided at the rear part to be made small.

Here, a large diameter is shown to be a diameter that exceeds 450 mm and a small diameter is shown to be a diameter less than or equal to 450 mm.

Steps for making a work roll diameter small are described above but if the biting problem and the rolling power transmission problem can be resolved, a small diameter work roll is extremely advantageous from the point of view of strong reduction force and economical use of energy and a twin mill can be configured using a rolling mill of a method for which control performance of strip crown and strip shape can be sufficiently guaranteed.

As described above, by giving a twin mill a tandem arrangement increases in production and stability of rolling can be achieved.

Sixth Embodiment

Next, a description is given of the present invention applied to a reversing type cold rolling mill.

The biggest feature of reversing cold rolling installations is that production of rolled steel strip can be started using little investment in equipment.

Expansion to a second and third machine is possible by expanding structures that are firstly constructed from one machine.

On the other hand, a problem with reversing type mills is that yield is poor compared with tandem mills.

The reason for this is that in general operations of reversing type cold rolling the strip of the first pass is sent to a coiler (reel) without being rolled and the leading end is bitten by a reel grip so as to be wound onto one or two coiling reels. The strip is then subjected to depression of a rolling mill and rolling commences.

When rolling in the reverse direction, portions that are not rolled are left at the leading and following ends of the strip so that the tail end of the strip remains wound about the reel, with these remaining portions then becoming scrap.

This kind of problem does not occur with a tandem mill because all of the strip is rolled, from the leading end to the trailing end. As a result, yield is high and production output is very high relative to reversing mills.

However, a tandem mill requires a great deal of investment compared with a reversing mill and for this reason alone a tandem mill is often not selected.

By contrast, maintaining and operating three or four of the same reversing type milis becomes very uneconomical.

Regarding this background, it would therefore be extremely beneficial to provide a rolling installation capable of providing production volumes in the middle of reversing methods and tandem mills at installation costs that are lower in relation to production volumes while preventing the lowering of yields encountered in reversible method rolling installations.

The twin mill is the perfect solution to these requirements.

Current single-stand reversing mills requiring three to five pass rolling is normal in response to product strip thickness.

With a twin mill two passes (four rollings) is standard, with there also being cases of three passes (six rollings) for particularly thin strips and one pass (two rollings) for thick items.

The configuration for this method is shown in FIG. 7.

FIG. 7 shows a four-high twin mill of the present invention employs a reversing method for finishing rolling, where rolled material is moved backwards and forwards by the coiler/uncoiler 42 and reverse-rolled for finishing by the four-high reverse twin mill 48.

A twin mill comprising a six-high rolling mill commonly referred to as a HC mill or UC mill of superior performance is preferred for cold rolling.

These twin mills can be considered to be two stand tandem mills of superior strip threading/tail extraction as described previously.

The case that rolling is possible with two rollings, i.e. one pass means that the same operations as for two tandem rolls is possible and the yield is not lowered because unrolled portions that occurred in related reversing methods no longer occur.

There is, however, a problem when the pass number is 2, i.e. when there are four rollings.

This is that the rolling mill that carried out the first pass also carries out the rolling of the final pass.

The leading and trailing ends of a rolled coil are cut by a usual travelling shears and this portion is then cooled for hardening so that when the returning sharp shape is rolled, and the likelihood of the work roll being damaged is high.

If a rolling pass is made one time, the leading end becomes rounded and there is no fear of damage to the roll in subsequent rolling but when the final rolling is carried out using the same work roll that carried out the first rolling, damage to this roll is transferred to the strip and product quality is lost.

This problem does not occur if sharp portions of the leading end of the coil are removed by a biter or grinder during waiting for rolling.

This is now described for the operation of a two pass reverse rolling (rolling four times) for the case provided above.

This first pass is essentially the same as for tandem rolling and is halted when the leading end of the threaded strip and the following end of the coil to be rolled come to the input side of No. 1 mill so as to prevent the end of the coil from damaging the roll. Reverse rolling is then starts and tail extraction is carried out in the same way as for usual tandem arrangements.

The lengths of unrolled parts for this method and the related one stand reversing mill will now be compared.

The yield for the case of producing a final strip of thickness 0.6 mm by carrying out four passes where the a 2.5 mm coil of raw material is reduced at a rate of 30% each pass is compared as an example.

Figure 16:
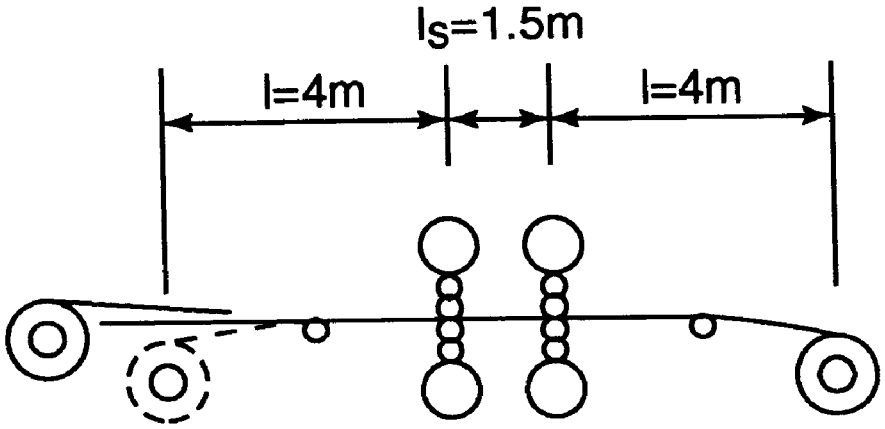
FIG. 16 is a view showing a configuration of a reversing twin mill constituting an embodiment of the present invention.
Figure 17:
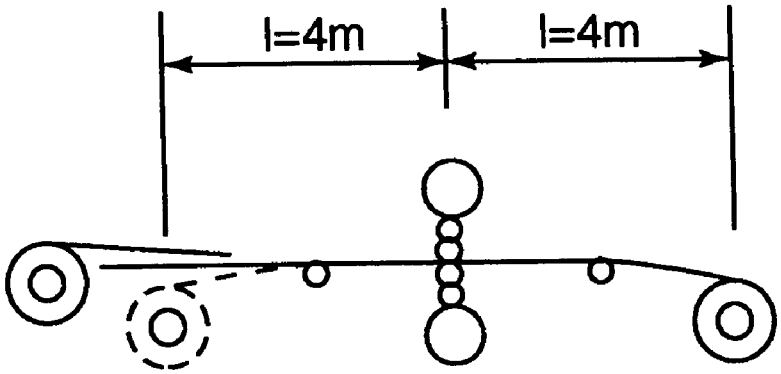
Fig.17 PRIOR ART
FIG. 17 is a view showing a configuration of a related reversing mill.

This arrangement is shown in FIG. 16 and FIG. 17.

In a first pass of the related method of FIG. 17, taking the raw material coil strip thickness to be 2.5 mm, the product strip thickness to be 0.6 mm, the distance between the mill and the reel to be 4 m and the leading end coiled length to be 3 m, then the length of the unrolled part at the first pass is (4 m+3 m)×(2.5 mm/0.6 mm)=29 m.

Taking the rate of reduction of thickness due to depression in the first pass to be 0.7, the length of the unrolled bars in the second pass becomes (4 m+3 m)×(2.5 mm×0.7/0.6 mm)=20.4 m.

Taking the length of the unrolled portion to be zero in the third pass and fourth pass, the total length La of the unrolled part of in the related method is La=29+20.4=49.4 m.

Next, with the twin mill of the present invention of FIG. 16, taking the distance between roll groups to be 1.5 m and the length of the unrolled portion in the first pass to be zero, in the second pass this becomes 1.5 m×(2.5 mm×0.7/0.6 mm)=4.4 m, i.e. the total length of the unrolled portion of the present invention becomes Lb=4.4 m.

Comparing the lengths of product strip thickness conversion for the not-completely rolled portions, an improvement of 45 m (La−Lb=49.4−4.4) can be seen.

In the case of a width of 1 m and a unit weight of 15 Tf, the overall coil length Lc for a product thickness of 0.6 mm is Lc=15000/(7.85×0.6)=3190 m. The increase in yield at a twin mill will then be (La−Lb)/Lc=(49.4−4.4)/3190=0.014.

It is therefore possible to raise yield by 1.4% with a twin mill of the present invention.

Production also approximately doubles as a product can be produced using half the number of passes.

In order to reduce the amount of wasted time, with standard two-pass rolling, the material coil uncoiling side and the coil winding side are taken to be the same side so that the coil extracting operation and the strip passing coiling on of the next coil do not interfere with each other, with an arrangement where the unwound coil can be immediately wound on for strip passing being preferable.

As the installation costs are 15% compared with related reversing methods and production is 200%, the production is improved by 30% with respect to installation costs.

By applying a twin mill to reversing method rolling, production can be approximately doubled with installation costs that are 1.3 to 1.5 times those of single mill reverse rolling.

According to the present invention, there is provided a rolling mill, rolling method and rolling installation that are easily maintained and of superior rolling efficiency where the distance between two sets of roll groups is shortened and strip walking and strip bending of rolling material is prevented.

What is claimed is:

1. A rolling mill comprising a four-high rolling mill equipped with roll groups composed of upper and lower work rolls above and below a rolling material and upper and lower back-up rolls supporting said upper and lower work rolls, respectively, wherein two of said roll groups are housed within a single roll housing, with driving taking place at one side in an axial direction of said roll groups and operating taking place on the remaining side, and metal chocks of said work rolls support two work rolls as a single body on upper and lower sides and on separate driving and operating sides.

2. The rolling mill of claim 1, wherein strip threading guides for threading strips of said rolling material between said two groups of rolls are attached at said metal chocks of said work rolls.

3. The rolling mill of claim 1, wherein a tension meter for detecting tension of said rolling material is provided at at least one of said metal chocks for said upper and lower work rolls.

4. The rolling mill of claim 1, wherein cylindrical supports are provided at sliding parts of said metal chocks of said work rolls and said housing in such a manner that sliding surfaces of said metal chocks of said work rolls and said housing maintain surface contact with respect to inclination of said metal chocks.

5. The rolling mill of claim 1, wherein, when rolling said rolling material, said two upper work rolls and said two lower work rolls of said two sets of roll groups are inclined in opposite directions within a horizontal plane taking a point of intersection of a path center line at the center of a widthwise direction of said rolling material and a center line for the axial direction of both roll groups as center.

6. The rolling mill of claim 1, wherein, when rolling the rolling material, said two upper work rolls, said two upper back up rolls, said two lower work rolls and said two lower back up rolls of said two sets of roll groups are inclined in opposite directions up and down within a horizontal plane taking a point of intersection of a path center line at the center of a widthwise direction of said rolling material and a center line for the axial direction of both roll groups as center.

7. The rolling mill of claim 1, wherein said two upper work rolls and said two lower work rolls of said two sets of roll groups are shifted in axial directions in opposite directions.

8. The rolling mill of claim 1, wherein thrust in the axial direction of said back-up rolls is received by one thrust bearing device at the center line of the roll axis.

9. The rolling mill of claim 1, wherein a rolling mill driving said intermediate rolls or said back-up rolls has means for setting roll benders of said work rolls to greater than a predecided set value at the time of strip biting of said rolling material.

10. The rolling mill of claim 1, wherein means for pressing using hydraulics is provided in such a manner that a space between said metal chock sliding surface and said housing sliding surface becomes small at at least the sliding part of the metal chock for the work roll.

11. The rolling mill of claim 2, wherein a tension meter for detecting tension of said rolling material is provided at at least one of said metal chocks for said upper and lower work rolls.

12. The rolling mill of claim 2, wherein cylindrical supports are provided at sliding parts of said metal chocks of said work rolls and said housing in such a manner that sliding surfaces of said metal chocks of said work rolls and said housing maintain surface contact with respect to inclination of said metal chocks.

13. The rolling mill of claim 3, wherein cylindrical supports are provided at sliding parts of said metal chocks of said work rolls and said housing in such a manner that sliding surfaces of said metal chocks of said work rolls and said housing maintain surface contact with respect to inclination of said metal chocks.

14. The rolling mill of claim 5, wherein spherical supports are provided at sliding parts of said metal chocks of said work rolls and said roll housing in such a manner that sliding surfaces of said metal chocks of said work rolls and said roll housing maintain surface contact with respect to inclination in the horizontal and vertical direction of said metal chocks.

15. The rolling mill of claim 6, wherein spherical supports are provided at sliding parts of said metal chocks of said work rolls and said roll housing in such a manner that sliding surfaces of said metal chocks of said work rolls and said roll housing maintain surface contact with respect to inclination in the horizontal and vertical direction of said metal chocks.

16. A rolling mill comprising a six-high rolling mill equipped with roll groups composed of upper and lower work rolls above and below a rolling material, upper and lower intermediate rolls supporting said upper and lower work rolls, respectively, wherein two of said roll groups are housed within a single roll housing, and upper and lower back-up rolls supporting said upper and lower intermediate rolls, respectively, with driving taking place at one side in an axial direction of said roll groups and operating taking place on the remaining side, and at least metal chocks of said work rolls support two work rolls as a single body on upper and lower sides and on separate driving and operating sides.

17. The rolling mill of claim 16, wherein said metal chocks for said intermediate rolls support two intermediate rolls as single pieces separately at the upper and lower sides and at said driving and operating sides.

18. The rolling mill of claim 16, wherein strip threading guides for threading strips of said rolling material between said two groups of rolls are attached at said metal chocks of said work rolls.

19. The rolling mill of claim 16, wherein a tension meter for detecting tension of said rolling material is provided at at least one of said metal chocks for said upper and lower work rolls.

20. The rolling mill of claim 16, wherein cylindrical supports are provided at sliding parts of said metal chocks of said work rolls and said housing in such a manner that sliding surfaces of said metal chocks of said work rolls and said housing maintain surface contact with respect to inclination of said metal chocks.

21. The rolling mill of claim 16, wherein thrust in the axial direction of said back-up rolls is received by one thrust bearing device at the center line of the roll axis.

22. The rolling mill of claim 16, wherein a rolling mill driving said intermediate rolls or said back-up rolls has means for setting roll benders of said work rolls to greater than a predecided set value at the time of strip biting of said rolling material.

23. The rolling mill of claim 16, wherein means for pressing using hydraulics is provided in such a manner that a space between said metal chock sliding surface and said housing sliding surface becomes small at at least the sliding part of the metal chock for the work roll.

24. The rolling mill of claim 17, wherein said two upper intermediate rolls and said two lower intermediate rolls are axially shifted in opposite directions via said metal chocks of said intermediate rolls.

25. The rolling mill of claim 24, wherein said two upper work rolls and said two lower work rolls are axially shifted in opposite directions via said metal chocks of said work rolls substantially simultaneously with axial movement of said two upper intermediate rolls and said two lower intermediate rolls.

26. A rolling method for a four-high rolling mill equipped with roll groups composed of upper and lower work rolls above and below a rolling material and upper and lower back-up rolls supporting said upper and lower work rolls, respectively, wherein two of said roll groups are housed within a single roll housing, said method comprising:

housing two of said roll groups within a single roll housing, providing metal chocks for said work rolls as respective single bodies supporting two work rolls each on upper and lower sides and at separate axially spaced driving and operating sides, and driving said roll groups from the driving side and operating the roll groups from the operating side.

27. The rolling method of claim 26, comprising setting a work roll bender with a value equal to or greater than a predetermined setting value at the time of strip biting of said rolling material and carrying out rolling operations.

28. The rolling method of claim 26, comprising disposing at least one of said rolling mills in a rolling direction and carrying out rolling in one direction through said at least one of said rolling mills.

29. The rolling method of claim 26, comprising carrying out reversible rolling in said rolling mill.

30. The rolling method of claim 26, comprising alternately grinding said work rolls or said intermediate rolls one roll at a time by a grinder while remaining attached to said metal chocks and during rolling operations.

31. The rolling method of claim 27, comprising disposing at least one of said rolling mills in a rolling direction and carrying out rolling in one direction through said at least one of said rolling mills.

32. The rolling method of claim 27, comprising carrying out reversible rolling in said rolling mill.

33. The rolling method of claim 27, comprising alternately grinding said work rolls or said intermediate rolls one roll at a time by a grinder while remaining attached to said metal chocks and during rolling operations.

34. The rolling method of claim 25, comprising alternately grinding said work rolls or said intermediate rolls one roll at a time by a grinder while remaining attached to said metal chocks and during rolling operations.

35. The rolling method of claim 28, wherein a plurality of rolling mills are disposed in the rolling direction and rolling is carried out in one direction through said plurality of rolling mills.

36. The rolling method of claim 29, comprising alternately grinding said work rolls or said intermediate rolls one roll at a time by a grinder while remaining attached to said metal chocks and during rolling operations.

37. A rolling method for a six-high rolling mill equipped with roll groups composed of upper and lower work rolls above and below a rolling material, upper and lower intermediate rolls supporting said upper and lower work rolls, respectively, wherein two said roll groups are housed within a single roll housing, and upper and lower back-up rolls supporting said upper and lower intermediate rolls, respectively, said method comprising:

housing two of said roll groups within a single roll housing, providing metal chocks for said work rolls as respective single bodies supporting two work rolls each on upper and lower sides and at separate axially spaced driving and operating sides, and driving said roll groups from the driving side and operating the roll groups from the operating side.

38. The rolling method of claim 37, comprising setting a work roll bender with a value equal to or greater than a predetermined setting value at the time of strip biting of said rolling material and carrying out rolling operations.

39. The rolling method of claim 37, comprising disposing at least one of said rolling mills in a rolling direction and carrying out rolling in one direction through said at least one of said rolling mills.

40. The rolling method of claim 37, comprising carrying out reversible rolling in said rolling mill.

41. The rolling method of claim 37, comprising alternately grinding said work rolls or said intermediate rolls one roll at a time by a grinder while remaining attached to said metal chocks and during rolling operations.

42. The rolling method of claim 39, wherein a plurality of rolling mills are disposed in the rolling direction and rolling is carried out in one direction through said plurality of rolling mills.

43. A hot rolling installation, equipped with a roughing mill and a finishing mill, with said hot-rolling installation rolling hot material at said finishing mill or rolling a slab cast at a thin slab caster as is at a finishing mill, wherein said finishing mill incorporates two sets of roller groups for a four-high rolling mill consisting of upper and lower work rolls and back-up rolls or a six-high rolling mill consisting of upper and lower work rolls, intermediate rolls and back-up rolls within a single housing, and at least a work roll bearing (metal chock) supports two work rolls as a single piece at driving and operating sides individually above and below.

44. A hot rolling installation, equipped with a roughing mill and a finishing mill, with said hot-rolling installation rolling hot material at said finishing mill or rolling a slab cast at a thin slab caster as is at a finishing mill, wherein said finishing mill incorporates two sets of roller groups for a four-high rolling mill consisting of upper and lower work rolls and back-up rolls or a six-high rolling mill consisting of upper and lower work rolls, intermediate rolls and back-up rolls within a single housing, and at least a work roll bearing (metal chock) supports two work rolls as a single piece at driving and operating sides individually above and below, with two of said finishing mills being arranged in tandem.

* * * * *